US006167874B1

(12) United States Patent
Becker et al.

(10) Patent No.: US 6,167,874 B1
(45) Date of Patent: Jan. 2, 2001

(54) PORTABLE HANDHELD WORK APPARATUS HAVING A FOUR-STROKE ENGINE

(75) Inventors: Georg Becker, Schwaikheim; Jürgen Häberlein, Murrhardt, both of (DE)

(73) Assignee: Andreas Stihl AG & Co., Waiblingen (DE)

( * ) Notice: Under 35 U.S.C. 154(b), the term of this patent shall be extended for 0 days.

(21) Appl. No.: 09/456,994

(22) Filed: Dec. 7, 1999

(30) Foreign Application Priority Data

Dec. 28, 1998 (DE) ..... 198 60 391

(51) Int. Cl.[7] ..... F02B 25/06
(52) U.S. Cl. ..... 123/572
(58) Field of Search ..... 123/572, 573, 123/574, 196 CP, 41.86, 65 VD, 184.21

(56) References Cited

U.S. PATENT DOCUMENTS 4,068,636 * 1/1978 Nau et al. ..... 123/572
4,162,662 * 7/1979 Melchior ..... 123/65 VD
4,962,617 10/1990 Tilders et al. .
5,014,663 * 5/1991 Melchior ..... 123/65 VD
5,361,738 11/1994 Iida .
5,582,145 * 12/1996 Aizawa et al. ..... 123/572
5,819,418 10/1998 Uhl .
5,947,068 * 9/1999 Araki ..... 123/41.86

FOREIGN PATENT DOCUMENTS 0615576 9/1994 (EP) .

* cited by examiner

*Primary Examiner*—Marguerite McMahon
(74) *Attorney, Agent, or Firm*—Walter Ottesen

(57) ABSTRACT

The invention relates to a motor-driven chain saw having an internal combustion engine for driving the saw chain of the chain saw. The engine is mounted in the housing of the chain saw and includes a cylinder and a combustion chamber formed in the cylinder. The combustion chamber is delimited by a piston and the piston drives a crankshaft via a connecting rod. The crankshaft is rotatably journalled in a crankcase. An inlet and an outlet are provided for gas exchange in the combustion chamber and the inlet is connected via an intake channel to a mixture preparation device. A stroke/bore ratio of less than 0.8 is used in order to provide an engine of reduced structural elevation which is useable in all positions. The inlet and outlet are controlled via valves having a valve drive charged with the air/fuel lubricating oil mixture supplied via the mixture preparation device.

8 Claims, 6 Drawing Sheets

29
28
48
35
27
45
36
46
43
48
44
48
40
25
24
OT
42
D
26
11
21
H
22
UT
47
23
48
48
49
r
38
37
20
41

PORTABLE HANDHELD WORK APPARATUS HAVING A FOUR-STROKE ENGINE

FIELD OF THE INVENTION

The invention relates to a portable handheld work apparatus such as a motor-driven chain saw, cutoff machine, hedge trimmer, blower apparatus, brushcutter or the like.

BACKGROUND OF THE INVENTION

U.S. Pat. No. 4,962,617 discloses a portable handheld work apparatus in the form of a cutoff machine having a drive motor configured as a two-stroke engine. The combustion chamber is delimited by the piston and is connected via transfer channels to the crankcase. The air/fuel lubricating oil mixture, which is needed for the operation, is drawn by suction via the crankcase and is conducted into the combustion chamber. Engines of this kind are especially suitable for use in portable handheld work apparatus because they combine low weight for the power generated with minimum complexity with respect to maintenance.

U.S. Pat. No. 6,819,418 discloses an overhead tree trimmer which includes a telescopic guide tube having a first end at which a drive motor is arranged and a second end on which a cutting device is mounted. The cutting device is a saw chain. Here too, a two-stroke engine is preferred as the drive motor and guarantees excellent manipulability of the overhead branch trimmer because of its low weight for the power generated.

In the same manner, U.S. Pat. No. 5,361,783 discloses a blower which utilizes a two-stroke engine for driving a blower wheel. The two-stroke engine has a minimum structural elevation which is measured in the direction of the cylinder axis and which is caused by the arrangement of the transfer channels and the inlet and outlet windows. This minimum structural elevation cannot be made any less.

European patent publication 0,615,576 discloses a brushcutter having a four-stroke engine. A separate lubricating-oil loop is provided for lubricating the moving parts of the four-stroke engine. On the one hand, a four-stroke engine of this kind is advantageous with respect to the exhaust-gas performance but the arrangement of the separate lubricating-oil loop leads to considerable technical complexity whereby the four-stroke engine is built large, is heavy and must have a corresponding quantity of lubricating oil ready for use in addition to a fuel tank. The engine is only reliable to a limited extent in all positions and requires a regular and complex maintenance because of the technically complex construction. This known separately lubricated four-stroke engine is built larger and heavier than a two-stroke engine. For this reason, the housing must be newly constructed for use in portable handheld work apparatus while also considering the center of gravity which changes because of the increased weight.

SUMMARY OF THE INVENTION

It is an object of the invention to provide a work apparatus of the kind described above which is improved so that the exhaust-gas emissions are significantly reduced compared to a two-stroke engine. It is still another object of the invention to provide such a work apparatus which provides greater convenience as to maintenance and for which the mounting space and the weight of the engine remains low.

The portable handheld work apparatus of the invention includes a motor-driven chain saw, cutoff machine, hedge trimmer, blower apparatus, brushcutter or the like. The portable handheld work apparatus includes a work tool and an internal combustion engine for driving the work tool. The engine includes: a cylinder; a piston movably mounted in the cylinder; the cylinder and the piston conjointly delimiting a combustion chamber; the cylinder having an intake opening and an intake valve for opening and closing the intake opening; the cylinder having an exhaust opening and an exhaust valve for opening and closing the exhaust opening; a valve housing connected to the cylinder; the intake valve and the exhaust valve movably mounted in the valve housing; a crankcase connected to the cylinder and communicating with the valve housing; a crankshaft rotatably journalled in the crankcase; a connecting rod interconnecting the piston and the crankshaft; the piston reciprocating in the cylinder to rotatingly drive the crankshaft via the connecting rod and alternately generate an overpressure and an underpressure in the crankcase; a valve drive assembly driven by the crankshaft for actuating the intake valve and the exhaust valve; a mixture-preparation device for supplying an air/fuel lubricant mixture; an intake channel conducting the mixture to the intake valve and the combustion chamber; means for charging the valve drive assembly and the valve housing with at least a portion of the air/fuel lubricant mixture in response to the overpressure and underpressure; and, the engine being a short stroke engine having a stroke/bore ratio of less than 0.8.

The elevation, which is measured in the direction of the cylinder axis, is significantly reduced because of the short-stroke configuration of the engine with a stroke-bore ratio of less than 0.8. For this reason, the dimensions in the direction of the vertical axis of the cylinder do not become greater than for a two-stroke engine because of the arrangement of the inlet and outlet valves and their cam drive notwithstanding the valve housing. By eliminating the transfer channels, the cylinder bore can be configured larger so that, in the end result, the stroke volume of the engine remains essentially unchanged when the piston stroke is short.

The lubrication of all movable parts in each position of the engine is guaranteed by the selected mixture supply to the valve drive, the valve housing, and the crankcase. A separate oil loop is not required because the pumping of the mixture via the crankcase pressure (crankcase pump) ensures an adequate lubrication in every operational position of the engine. In this way, an excellent all-position reliability at low weight results and the lubrication remains reliable even at extreme temperatures. The engine according to the invention is therefore especially suitable for motor-driven chain saws.

Because of the mixture lubrication, only one fuel tank is needed for the engine so that the fuel/lubricating oil mixture can still be used in a manner known per se as is conventional in the case of a two-stroke engine. In this way, the four-stroke engine according to the invention can be exchanged for and mounted in lieu of a two-stroke engine. Larger changes on the housing become unnecessary because of the approximately same mounting space as needed for a two-stroke engine. The structural complexity of the four-stroke engine is low because of the mixture lubrication which is provided since oil loops, oil wiper rings or like components are unnecessary.

Advantageously, the valve drive assembly, the valve housing and the crankcase are connected to the intake channel via a common connecting channel. In a first embodiment, the crankcase is connected to the intake channel exclusively via the valve drive assembly, the valve housing and the connecting channel. It has been surprisingly shown that a connection of this kind to the intake channel results in a lubrication which operates in all positions.

In another embodiment of the invention, the valve drive assembly, the valve housing, the crankcase and the first connecting channel together with a second connecting channel are configured as an annular line so that the intake channel is connected via the second connecting channel to the crankcase, the crankcase is connected via the valve drive assembly to the valve housing and the valve housing is again connected via the first connecting channel to the intake channel. In a configuration of this kind, the mixture guidance takes place essentially in a flow direction.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
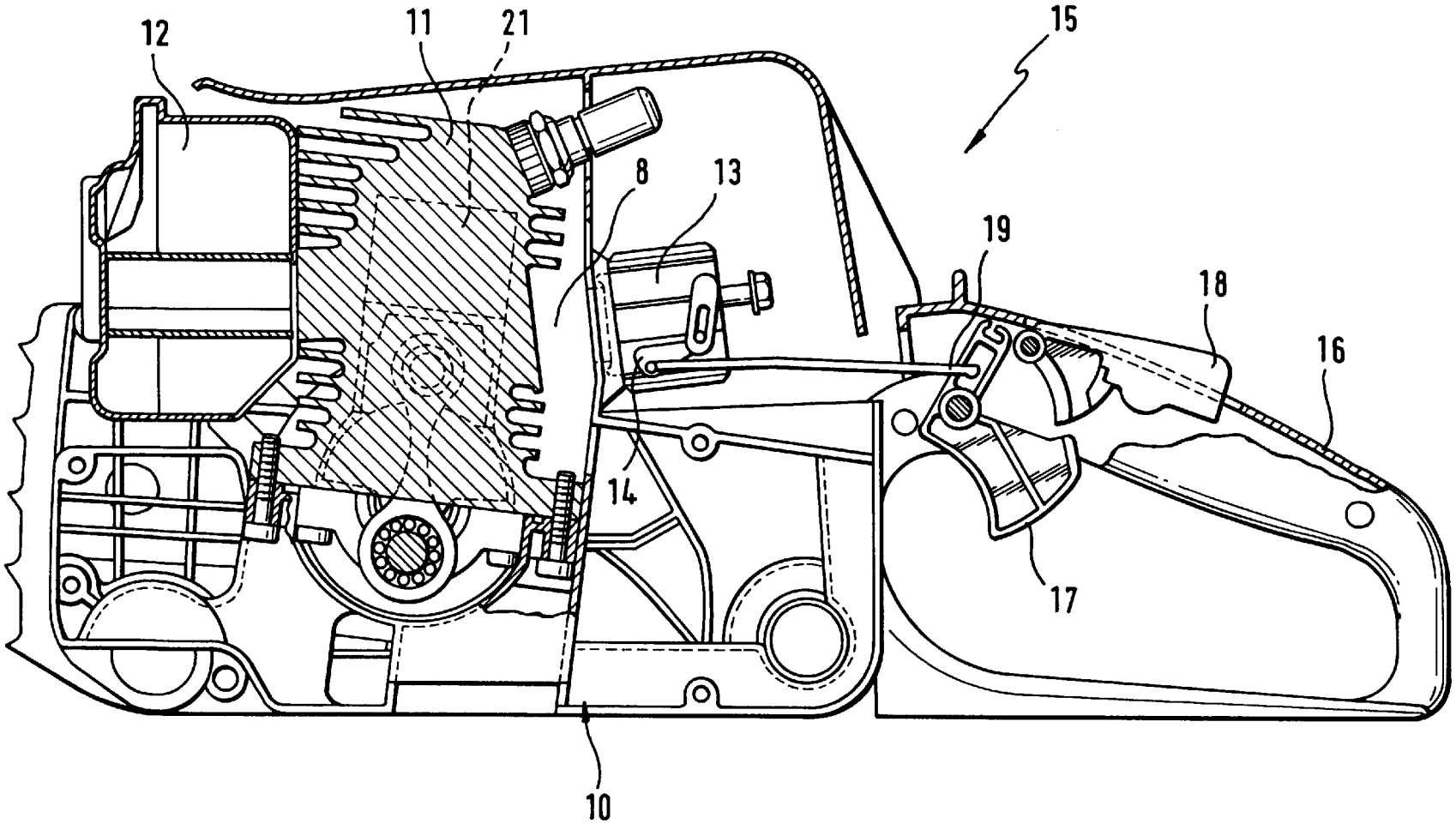
FIG. 1 is a side elevation view, partially in section, of a motor-driven chain saw equipped with an internal combustion engine according to the invention.
Figure 2:
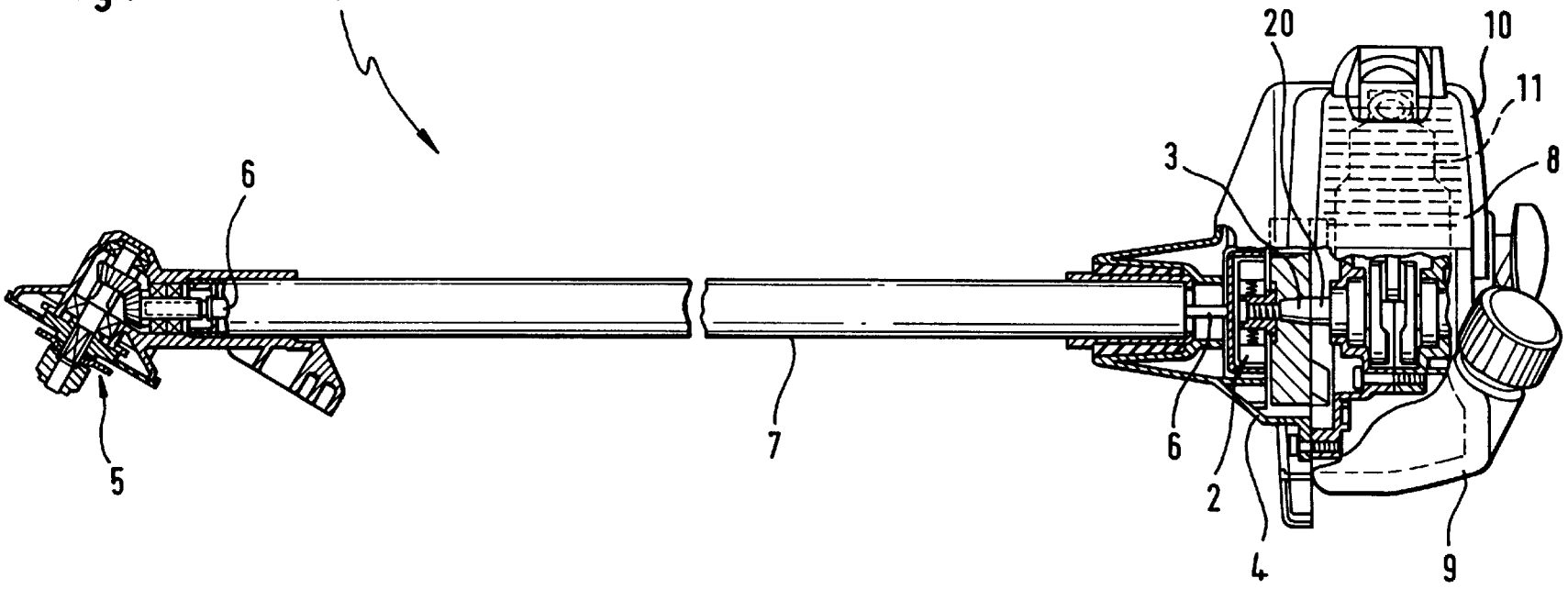
FIG. 2 is a section view of a brushcutter equipped with an internal combustion engine according to the invention.

The portable handheld work apparatus shown in FIGS. 1 and 2 are shown as exemplary. FIG. 1 shows a motor-driven chain saw and FIG. 2 a brushcutter. The use of the internal combustion engine according to the invention is generally for a portable handheld work apparatus including hedge trimmers, cutoff machines, blower apparatus or the like.

The motor-driven chain saw 15 shown in FIG. 1 includes a housing 10 having a rearward handle 16 in which a throttle lever 17 is journalled together with a throttle lever latch 18 corresponding thereto. The throttle lever 17 is connected via a throttle linkage 19 to a throttle flap lever 14 of a carburetor 13 which is mounted within the housing 10. A combustion chamber 21 is provided with mixture via the carburetor 13. The combustion chamber 21 is provided in the cylinder 11 of the engine arranged in the housing 10. The exhaust gases are conducted away from the combustion chamber 21 via an exhaust-gas muffler 12.

The mounting space 8 in the housing 10 of the motor-driven chain saw 15 is configured so as to be adapted to the engine in order to hold the total structural size of the work apparatus low so that the apparatus can be simply and reliably manipulated.

In the same manner, a limited mounting space 8 for an engine is provided in the housing 10 in the brushcutter 1 of FIG. 2. The cylinder 11 of the engine lies completely within the housing 10. The engine is supplied with fuel from a fuel tank 9 and, in the embodiment shown, the fuel is in the form of a fuel/lubricating oil mixture. A clutch 2 is provided at the end 3 of the crankshaft 20 and is disposed within a forward structure 4. The clutch 2 is connected to an end of the drive shaft 6 which is journalled in a guide tube 7. A cutterhead 5 is connected to the other end of the drive shaft 6. The cutterhead 5 carries a knife, a cutting filament or like tool for cutting grass, brush or the like. The brushcutter 1 is carried by the operator and must therefore be configured so as to have a weight as low as possible.

The engines used in the work apparatus of FIGS. 1 and 2 correspond in configuration to the schematics shown in FIGS. 3 to 6 wherein the same parts have the same reference numerals.

Figure 3:
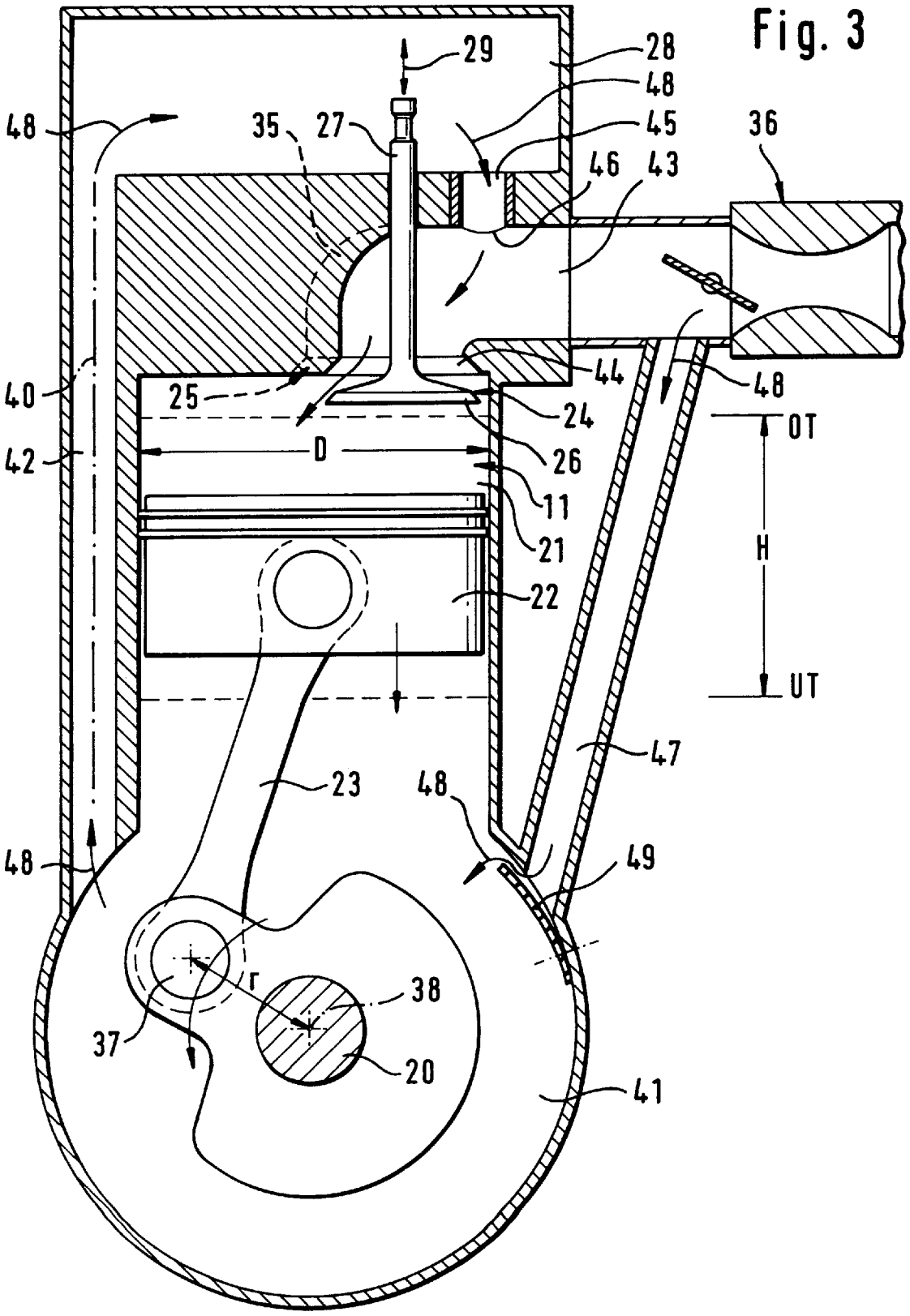
FIG. 3 is a side elevation view, in section, showing an embodiment of the internal combustion engine according to the invention suitable for a portable handheld work apparatus.
Figure 4:
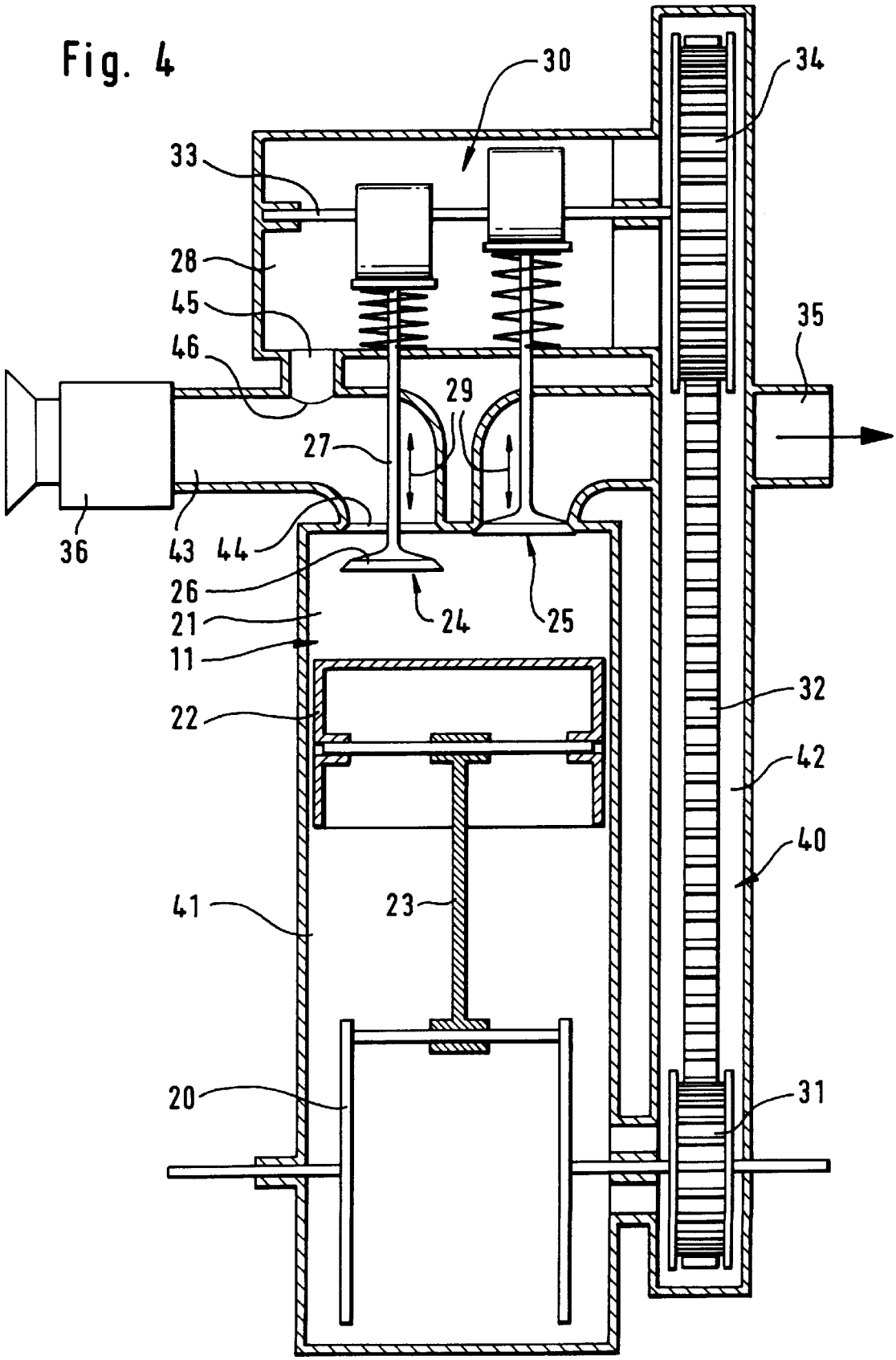
FIG. 4 is a section view of an internal combustion engine according to another embodiment of the invention.
Figure 5:
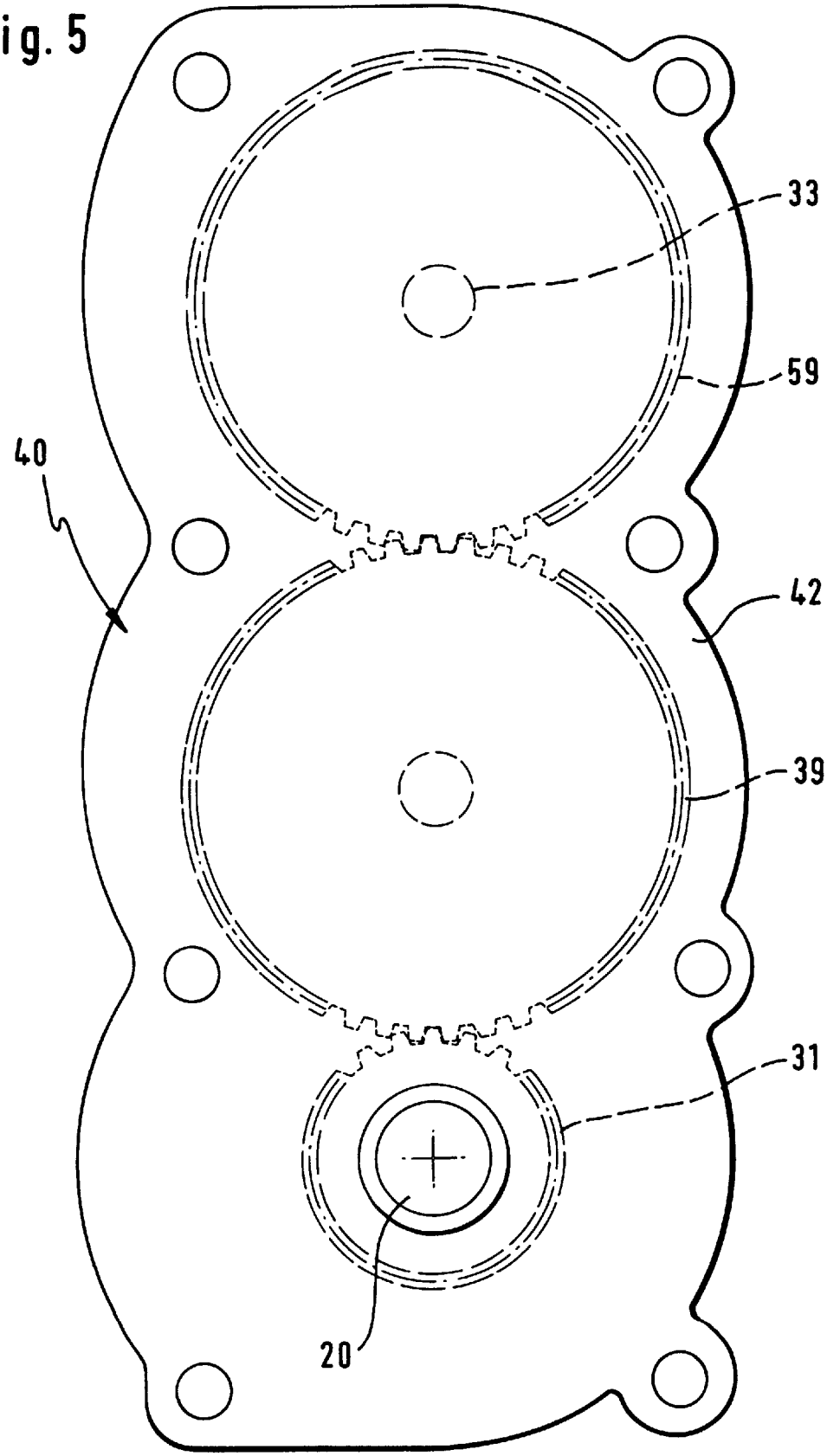
FIG. 5 is a schematic representation of a wheel drive between the crankshaft and the camshaft lying thereabove; and, FIG. 6 is a section view showing the push-rod drive for the valves.

The mixture lubricated four-stroke engine schematically shown in FIGS. 3 and 4 comprises the cylinder 11 having a piston 22 arranged therein which delimits the combustion chamber 21 with a bore diameter D. The combustion chamber 21 is provided in the cylinder 11. An ignitable air/fuel lubricating oil mixture is supplied to the combustion chamber 21 preferably via an inlet valve 24 and the exhaust gas is conducted away via an outlet valve 25. These valves are gas-exchange valves. The inlet valve 24 comprises a valve plate 26 having a valve stem 27 projecting into a valve housing 28 wherein a cam drive 30 moves the valve stem 27 up and down in the direction of arrow 29. The outlet or discharge valve 25 is controlled in the same manner.

The cam drive 30 is disposed in the valve housing 28 and is driven via a valve drive 40 by the crankshaft 20 rotatably journalled in the crankcase 41. The crankshaft 20 is connected via a connecting rod 23 to the piston 22. In the embodiment shown, the valve drive 40 is arranged in a channel 42 as a belt or chain drive. The channel 42 simultaneously defines a flow connection between the crankcase 41 and the valve housing 28. The crankshaft 20 supports a drive wheel 31 for a belt 32 or a chain. The shaft 33 of the cam drive 30 carries a corresponding belt wheel 34 for the belt 32 or a sprocket wheel for a chain.

As shown in FIGS. 3 and 4, the inlet opening 44 of the inlet valve 24 extends from an intake channel 43 which connects the inlet opening 44 to a mixture preparation unit 36.

The valve housing 28 is connected via a first connecting channel 45 to the intake channel 43 near the inlet valve 44. The opening of the first connecting channel 45 into the intake channel 43 lies approximately opposite the inlet opening 44. The opening 46 of the first connecting channel 45 can be rounded and is preferably oval or approximately circular.

The embodiments of FIGS. 3 and 4 differ from each other in that the intake channel 43 shown in FIG. 3 is connected to the crankcase 41 via a second connecting channel 47. In this way, the second connecting channel 47, the crankcase 41, the channel 42 of the valve drive 40, the valve housing 28 and the first connecting channel 45 define a loop conduit via which the air/fuel lubricating oil mixture is moved in the direction of arrows 48 during operation of the engine. The air/fuel lubricating oil mixture is made available by the mixture preparation device 36. In this way, the crankcase 41, the valve drive 40, as well as the cam drive 30 in the valve housing 28 are continuously charged with the air/fuel lubricating oil mixture so that a reliable lubrication of all moving parts is ensured in every position of the engine.

To reinforce the direction of movement in the direction of arrows 48, a membrane valve 49 is mounted in the crankcase 41 at the opening of the second connection channel 47. The membrane valve 49 opens when there is an underpressure in the crankcase 41 and permits an inflow into the crankcase 41 of the air/fuel lubricating oil mixture; whereas, the membrane valve 49 closes when there is an overpressure in the crankcase so that the part of the inducted air/fuel lubricating oil mixture is moved via the channel 42 into the valve housing 28 and via the first connecting channel 45 in the direction toward the inlet opening 44.

In the embodiment of FIG. 4, the crankcase 41, the valve drive 40 and the valve housing 28 are connected to the intake channel 43 only via the first connecting channel 45 so that the air/fuel lubricating oil mixture is inducted and discharged via the first connecting channel 45. The flow connection between the crankcase 41 and the valve housing 28 is then adequate via the channel 42 so that it is not necessary to provide an additional conduit.

The inlet valve 24 is opened when the piston 22 moves downwardly and an air/fuel lubricating oil mixture is drawn in by suction from the mixture preparation device 36 via the intake channel 43. The piston 22 moves upwardly in the combustion chamber 21 during the compression stroke which follows the intake stroke. The inlet valve 24 and the outlet valve 25 are closed during this time. An underpressure develops in the crankcase 41 because of the upwardly-traveling piston 22 and this underpressure is present also in the valve housing 28 via the channel 42 of the valve drive 40 so that an air/fuel lubricating oil mixture is drawn by suction via the first connecting channel 45 from the intake channel 43 and into the crankcase 41 via the channel 42. This inducted air/fuel lubricating oil mixture lubricates the movable parts, namely, the cam drive 30, the valve drive 40 and the bearing locations on the crankshaft 20 and connecting rod 23.

At the end of the compression stroke, the ignition follows and therefore the work stroke during which the crankshaft 20 is driven in rotation. After the work stroke, the outlet valve 25 opens and the gases generated in the combustion chamber 21 are discharged via the outlet valve 25 and the discharge channel 35. In the next induction stroke, the piston 22 again travels downwardly into the crankcase 41 whereby the air/fuel lubricating oil mixture, which is inducted into the crankcase 41 from the previous stroke, is moved via the channel 42 of the valve drive 40 to the valve housing 28 and is discharged into the intake channel 43 forward of the inlet valve 24 via the first connecting channel 45 thereby reinforcing the suction effect. The discharged mixture then mixes with the air/fuel lubricating oil mixture which flows into the combustion chamber 21 and enters the combustion chamber 21. In the following upward movement of the piston 22, the underpressure, which builds up in the crankcase 41, is compensated by the intake of new mixture components from the intake channel 43. Fresh components of the air/fuel lubricating oil mixture flow via the connecting channel 45 into the valve housing 28 and lubricate the valve drive 40 and flow further through the channel 42 to the crankcase 41 in order to lubricate the parts therein. In this way, the crankcase, which operates as a piston pump, effects an intense swirling of old mixture components with newly inducted mixture components because of the high dynamic whereby an adequate lubrication is ensured in all positions of the engine without the formation of oil puddles and with a continuous mixture exchange. An underpressure pulse becomes effective at the opening 46 of the first connecting channel 45 when the inlet valve 24 opens and this pulse supports an exchange of the mixture contained in the valve housing 28, that is, the underpressure draws the mixture out of the valve housing by suction. This advantageous dynamic effect ensures the exchange of the mixture without the volume, which is displaced by the piston, having to be smaller than the sum of the gas volumes of crankcase, valve housing and valve drive housing.

The volume of the valve housing 28 and the cross section of the connecting channel 45 are matched to each other in such a manner that, already in idle operation, a continuous exchange of the mixture components is achieved which are present in the crankcase 41, the valve drive channel 42 and the valve housing 28, so that, in idle operation, an adequate lubrication of the movable parts is ensured in every position of the engine without excessive deterioration of the mixture.

It can be advantageous to configure the total gas volume of the valve drive and of the valve housing as less than the crankcase volume displaced by the piston.

In the embodiment of FIG. 3 as well as in the embodiment of FIG. 4, the configuration is so provided that the upward and downward movement of the piston alone provides a rapid exchange of the volumes in the following: crankcase 41, valve drive channel 42 and the valve housing 28 via the first connecting channel 45 and/or the second connecting channel 47. The connecting channel 45 can be configured without a valve. It is advantageous to provide a membrane valve 49 in the region of the second connecting channel 47.

The four-stroke engine provided in accordance with the invention is configured with a stroke/bore ratio (H/D ratio) of less than 1 and especially less than 0.8. The structural height, which is measured in the direction of the vertical axis of the cylinder, was reduced by reducing the stroke H. At the same time, the stroke volume itself is substantially unchanged compared to a two-stroke engine having the same structural height because of the increase of the cylinder bore. The valve housing 28 is mounted axially on the cylinder 11 and therefore leads to no significant lengthening of the structural height of the four-stroke engine according to the invention so that the four-stroke engine can be utilized in any desired portable handheld work apparatus in lieu of a two-stroke engine. The structural height is measured in the direction of the cylinder axis.

The mixture lubricated four-stroke engine according to the invention corresponds in the mounting space volume to a two-stroke engine of comparable power so that the mounting space 8 (FIGS. 1 and 2), which is provided in the housing of a work apparatus, is sufficient to mount the engine according to the invention without changing the housing. The reduction of the distance (r) between the rotational axis 38 of the crankshaft 20 and the crank pin 37 of the connecting rod 23 also contributes to this situation. The distance (r) can be less than the sum of the radii of the connecting rod pin 37 and the crankshaft 20.

In FIG. 4, the valve drive 40 is configured as a belt or chain drive. Alternatively, the valve drive 40 of FIG. 5 can also be configured as a wheel drive and, for this purpose, the drive wheel 31, which is mounted on the crankshaft 20, is configured as a toothed wheel which drives, via an intermediate wheel 37, an output wheel 38 connected to the camshaft 33 so as to rotate therewith. The necessary rpm reduction of the crankshaft 20 to the camshaft 33 is achieved via a corresponding configuration of the drive wheel 31, intermediate wheel 37 and output wheel 38. In the embodiment shown in FIG. 5, the wheel gearing is configured as a spur-gear system which is mounted in the channel 42 between the crankcase 41 and the valve housing 28.

Figure 6:
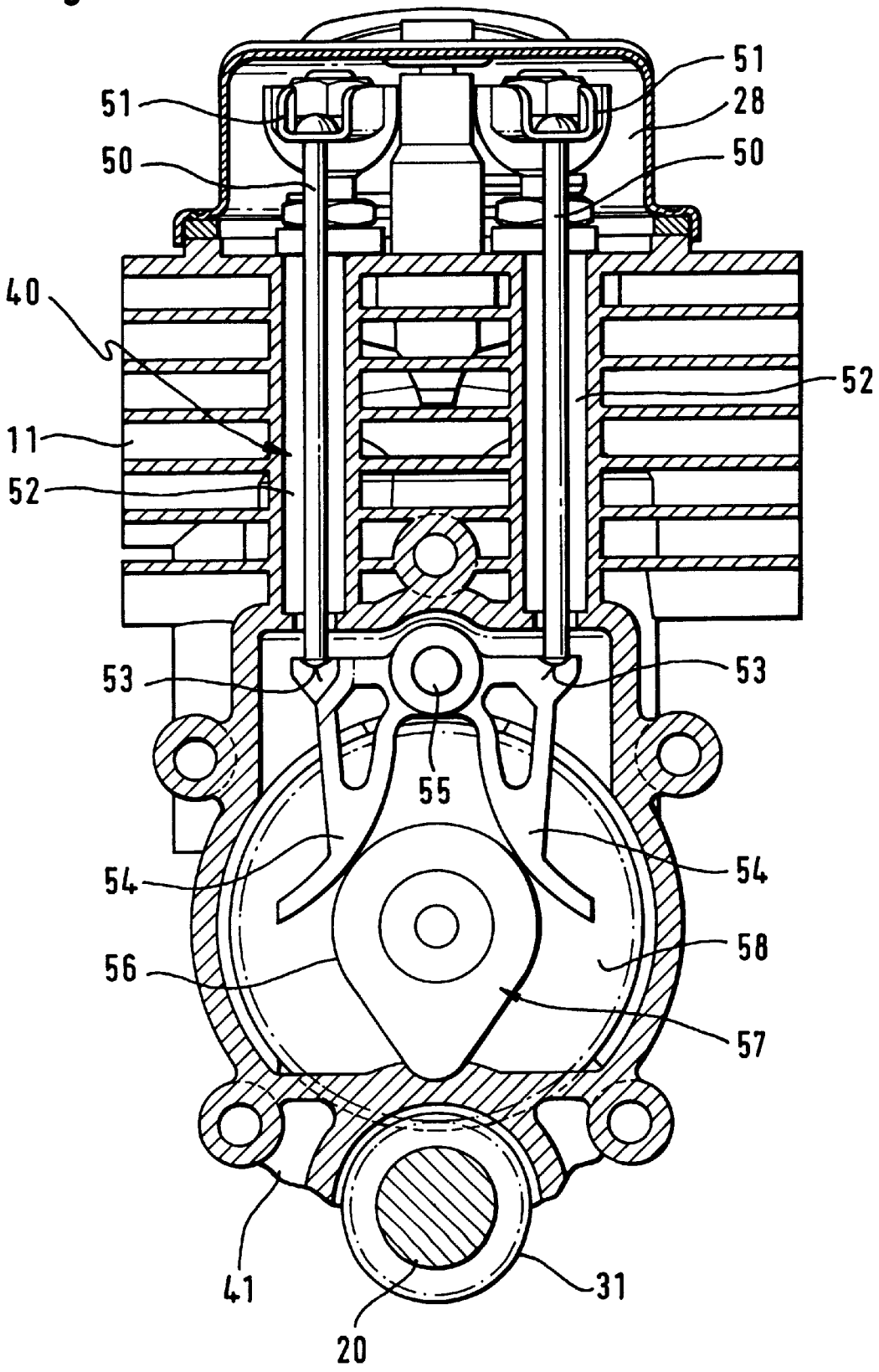

In the embodiment of FIG. 6, the valve drive 40 is configured as a push-rod drive. Here, the push rods 50 extend from the crankcase 41 beyond the cylinder 11 in elevation and into the valve housing 28 where they actuate the gas-exchange valves via corresponding tilt levers 51.

The push rods 50 are guided in rod bores 52 which simultaneously function as flow connections between the crankcase 41 and the valve housing 28. At their ends facing away from the tilt levers 51, the push rods 50 are disposed in respective pans 53 of two control levers 54 which are pivotally mounted on a common bearing pin 55 and lie, with their free ends, against the cam path 56 of a control cam 57. The control cam 57 is connected to the toothed wheel 58 so as to rotate therewith. The toothed wheel 58 meshes with the drive wheel 31 mounted on the crankshaft 20 so as to rotate therewith. The toothed wheel pairing of the drive wheel 31/toothed wheel 58 determines the necessary gear reduction of the crankshaft rpm to the rpm of the control cam 57.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus including a motor-driven chain saw, cutoff machine, hedge trimmer, blower apparatus, brushcutter, the portable handheld work apparatus comprising:

a work tool;

an internal combustion engine for driving said work tool;

said engine including:

a cylinder;

a piston movably mounted in said cylinder;

said cylinder and said piston conjointly delimiting a combustion chamber;

said cylinder having an intake opening and an intake valve for opening and closing said intake opening;

said cylinder having an exhaust opening and an exhaust valve for opening and closing said exhaust opening;

a valve housing connected to said cylinder;

said intake valve and said exhaust valve movably mounted in said valve housing;

a crankcase connected to said cylinder and communicating with said valve housing;

a crankshaft rotatably journalled in said crankcase;

a connecting rod interconnecting said piston and said crankshaft;

said piston reciprocating in said cylinder to rotatingly drive said crankshaft via said connecting rod and alternately generate an overpressure and an underpressure in said crankcase;

a valve drive assembly driven by said crankshaft for actuating said intake valve and said exhaust valve;

a mixture-preparation device for supplying an air/fuel lubricant mixture;

an intake channel conducting said mixture to said intake valve and said combustion chamber;

means for charging said valve drive assembly and said valve housing with at least a portion of said air/fuel lubricant mixture in response to said overpressure and underpressure; and, said engine being a short stroke engine having a stroke/bore ratio of less than 0.8.

2. The portable handheld work apparatus of claim 1, said charging means comprising a common connecting channel for connecting said valve drive assembly, said valve housing and said crankcase to said intake channel.

3. The portable handheld work apparatus of claim 2, said crankcase being connected exclusively to said intake channel via said valve drive assembly, said valve housing and said connecting channel.

4. The portable handheld work apparatus of claim 1, said charging means comprising a first connecting channel for connecting said valve drive assembly, said valve housing and said crankcase to said intake channel; and a second connecting channel between said intake channel and said crankcase; and, said valve housing, said valve drive assembly, said crankcase, said first connecting channel and said second connecting channel conjointly defining an annular path for said portion of said air/fuel lubricant mixture.

5. The portable handheld work apparatus of claim 2, said connecting channel having a cross section and said valve housing having a volume; and, said cross section and said volume being matched to each other in such a manner that, in idle operation of said engine, said air/fuel lubricant mixture provides an adequate lubrication of movable parts in said crankcase and of said valve drive assembly.

6. The portable handheld work apparatus of claim 1, said inlet being connected directly to said intake channel.

7. The portable handheld work apparatus of claim 1, said valve drive assembly including a wheel drive.

8. The portable handheld work apparatus of claim 1, said valve drive assembly including a push rod drive.

* * * * *

UNITED STATES PATENT AND TRADEMARK OFFICE

CERTIFICATE OF CORRECTION

PATENT NO. : 6,167,874 B1
DATED : January 2, 2001
INVENTOR(S) : Georg Becker and Juergen Haeberleing It is certified that error appears in the above-identified patent and that said Letters Patent is hereby corrected as shown below:

Column 6,
Line 51, delete "37" and substitute -- 39 --
Line 51, delete "38" and substitute -- 59 --
Line 55, delete "37" and substitute -- 39 --
Line 55, delete "38" and substitute -- 59 --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*